US005188628A

United States Patent [19]

Rani et al.

[11] Patent Number: 5,188,628

[45] Date of Patent: Feb. 23, 1993

[54] CLOSURE DEVICE FOR ENTERAL FLUID CONTAINERS

[75] Inventors: Robert G. Rani, Roseville; Douglas E. Hahn, Plymouth, both of Minn.

[73] Assignee: Sandoz Ltd., Basel, Switzerland

[21] Appl. No.: 609,676

[22] Filed: Nov. 6, 1990

[51] Int. Cl.[5] ..... A61M 5/32

[52] U.S. Cl. ..... 604/405; 604/415; 604/411; 215/248; 215/250; 215/261

[58] Field of Search ..... 604/405, 415, 905, 411; 215/248, 250, 261

[56] References Cited

U.S. PATENT DOCUMENTS

| | | | |
|---|---|---|---|
| 2,770,234 | 11/1956 | Nesset et al. | 604/405 |
| 3,905,368 | 9/1975 | Lewis, Jr. et al. | 604/415 |
| 4,301,799 | 11/1981 | Pope, Jr. et al. | 604/405 |
| 4,981,464 | 1/1991 | Suzuki | 604/415 |
| 4,997,429 | 3/1991 | Dickerhoff et al. | 604/411 |
| 5,036,992 | 8/1991 | Mouchawar et al. | 604/415 |

*Primary Examiner*—Robert A. Hafer
*Assistant Examiner*—Kerry Owens
*Attorney, Agent, or Firm*—Gerald D. Sharkin; Robert S. Honor; Carl W. Battle

[57] ABSTRACT

A closure device for connection to a fluid container which has an opening for receiving the device. The closure device has a base section which may sealably cover the container opening. The base section has a spike receiving opening passing there through with at least one air vent on the base section which is spaced from the spike receiving opening. A hydrophobic air filter, is associated with the air vent. Adjoining the base section is an internal cover, which lies over the aperture, covering it and the base section. The internal cover has a pierceable portion which is in alignment with the spike receiving opening of the base section.

11 Claims, 10 Drawing Sheets

CLOSURE DEVICE FOR ENTERAL FLUID CONTAINERS

BACKGROUND OF THE INVENTION

The present invention relates to fluid delivery systems. In one particular aspect, it relates to enteral fluid delivery systems utilizing closure devices for connection between an enteral fluid container and a patient feed line.

SUMMARY OF THE INVENTION

Broadly, the present invention provides a closure device for connection to a fluid container which has an opening for receiving the device. The closure device has a base section which may sealably cover the container opening. The base section has a spike receiving opening passing there through with at least one aperture, e.g., an air vent on the base section which is spaced from the spike receiving opening. An air filter e.g., hydrophobic air filter, is associated with the air vent. Adjoining the base section is an internal cover, which lies over the aperture, covering it and the base section. The internal cover has a pierceable portion e.g., a weakened section, which is in alignment with the spike receiving opening of the base section.

In a preferred embodiment of the invention, the closure device has a threaded wall portion projecting from the base section which wall portion is adapted to threadly receive a threaded connection of the fluid container. The fluid container may also have a pierceable seal covering the opening.

DETAILED DESCRIPTION OF THE PREFERRED EMBODIMENTS

Figure 1:
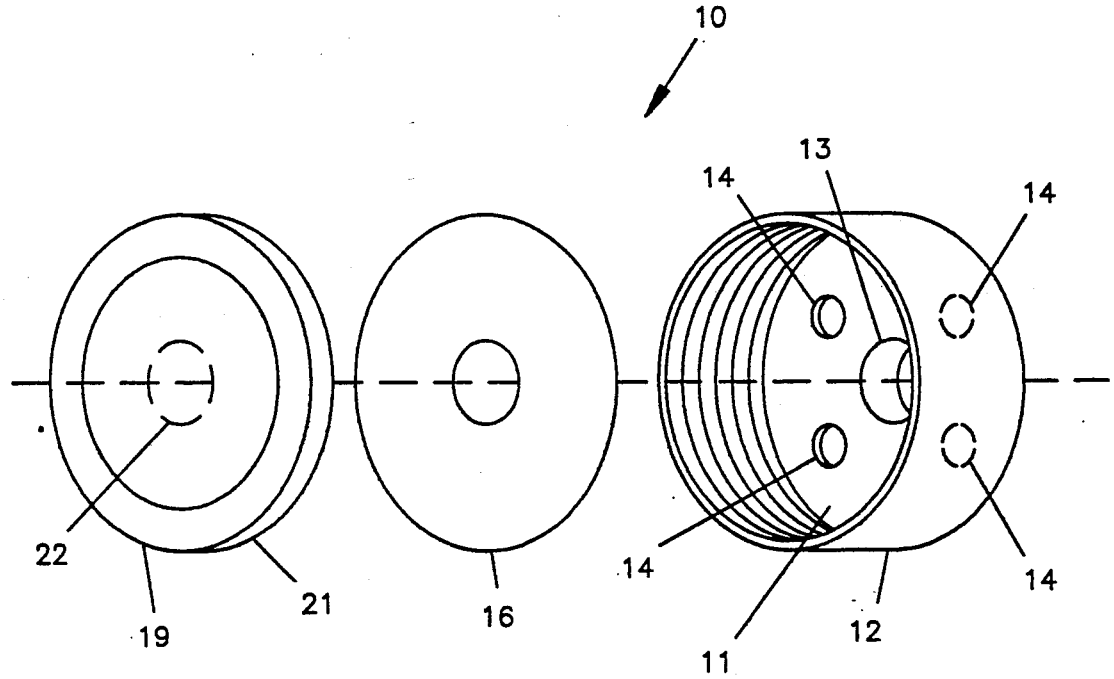
FIG. 1 is an isometric view of a closure device of this invention.
Figure 2:
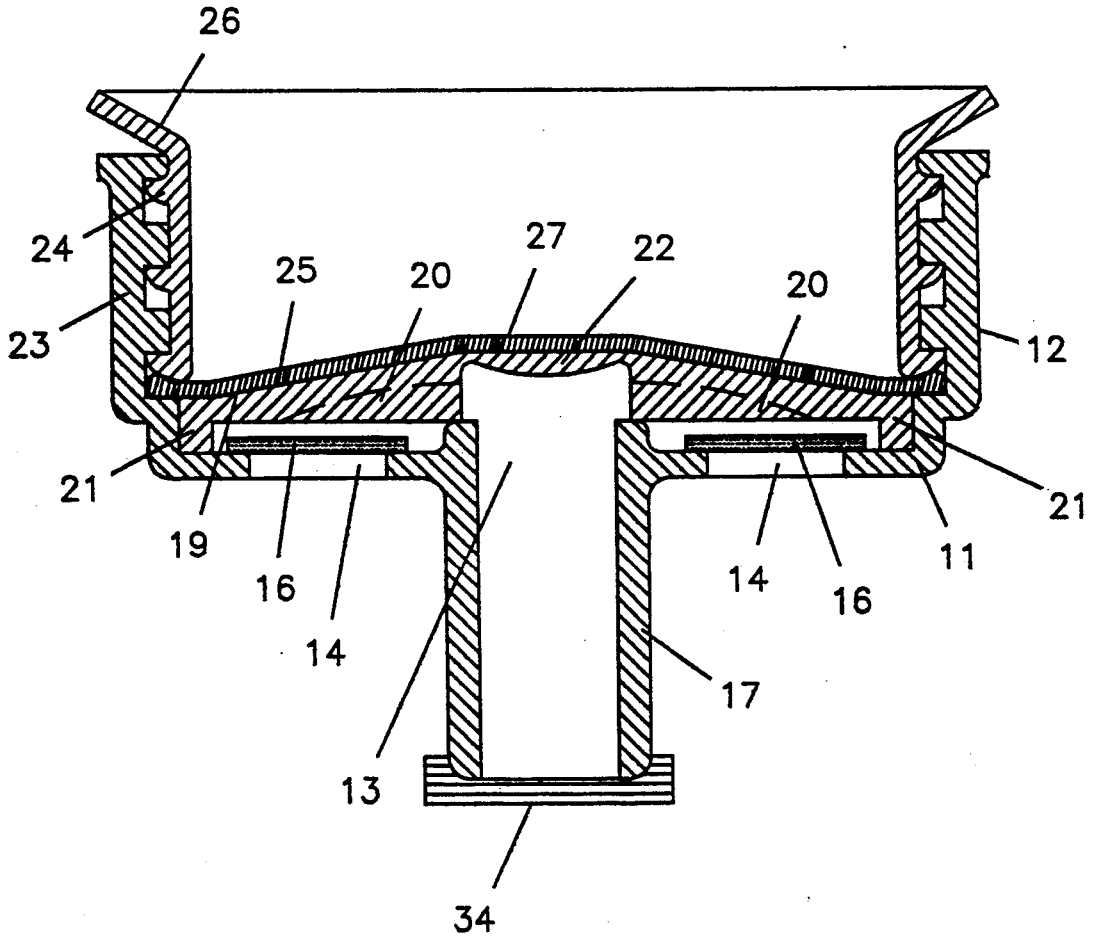
FIG. 2 is a perspective view of the closure device of FIG. 1, showing the device in connection with a fluid container.

Referring to FIGS. 1 and 2, the closure device 10 generally comprises a base section 11 and a threaded wall portion 12. The base section 11 has a spike receiving opening 13, and an air inlet aperture 14. There may be one or more air inlet apertures 14.

A hydrophobic air filter is associated with the air inlet apertures 14. The position and configuration of the filter may be varied depending upon the number of apertures 14. When multiple apertures are used, the filter may consist of a disk-like filter 16 as shown in FIG. 1. This filter 16 is preferably positioned on the inside of the closure device 10 (as shown in FIG. 1). It may also be positioned over the apertures on the outside of the closure device 10 (not shown).

Figure 3A:
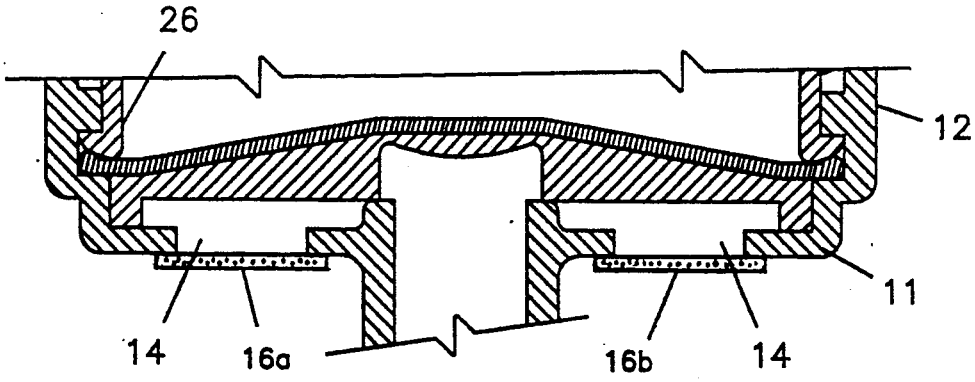
FIG. 3*a, b, c* and *d* are perspective views showing additional positions of the hydropholic air filter.
Figure 3B:
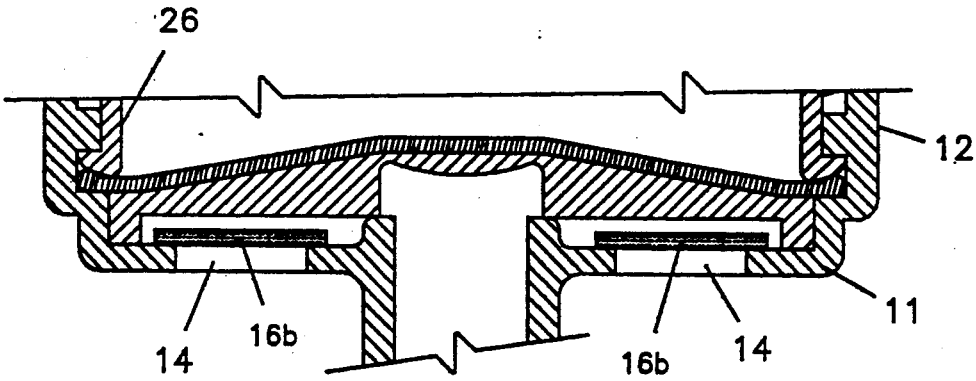
Figure 3C:
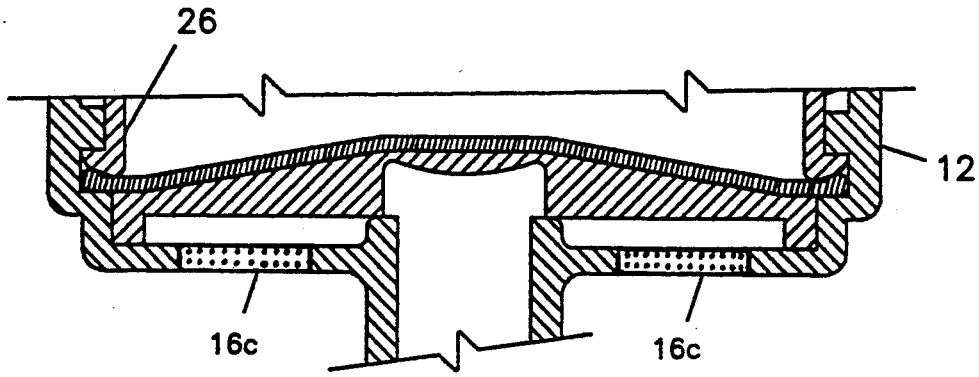
Figure 3D:
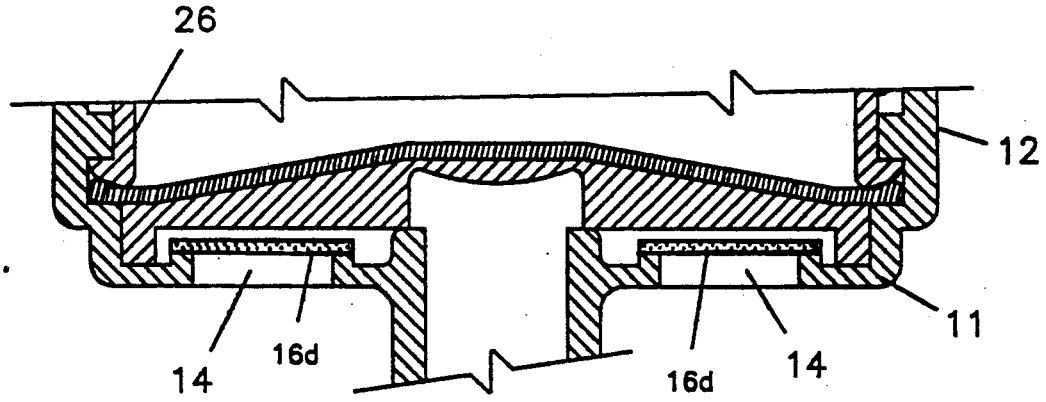

One or more apertures 14 may also be covered by individual filters which may cover the apertures on the outside of the closure device 10, the inside of the closure device, or may lie within the apertures. These filter positions 16*a*, 16*b*, 16*c* and 16*d* are shown in FIG. 3*a, b, c* and *d*. Filter position 16*d* differs from position 16*b*, in that it is raised from the base section 11. The preferred filter position is on the inside of the closure device (16*b*). The individual filter may be secured to the closure device by any suitable means e.g., sonic welding, so that it will remain in position in relation to the aperture. Suitable hydrophobic air filters may be obtained from Pallflex Products Corp. (Pallflex EMFAB E01008E).

A spike receiving cylindrical member 17, aligned with the spike receiving opening 13, extends outwardly from the base section 11. The opening 13 and the cylindrical member 17 are adapted to receive a piercing spike 18.

An internal cover 19 lies over the filter 16 and the base section 11. The cover 19 may have a plurality of rib members 20, to support and maintain the integrity of the cover. The cover may have a raised edge section 21 which may be adhered to the base section 11; and may have a center portion 22 which is in alignment with the spike receiving opening 13, and the cylindrical member 17, of the base section 11. Preferably, the internal cover 19 is concave in hape on its external surface, e.g., the surface facing away from the base section (see FIG. 2).

As shown in FIG. 2, the wall portion 12 of the closure device is threaded 23, to threadably receive the threaded neck 24 of a fluid container 26, e.g., an enteral fluid container. The container 26 has a seal 27, e.g., a foil seal, across the container opening. When the closure device 10 is attached to the container 26 (as shown in FIG. 2), the foil seal 27 contacts the cover 19.

In a preferred embodiment, the foil seal 27 may be adhesively sealed 25 to the cover 19. Preferably, the foil 27 is adhesively hot sealed (aseptically sealed) to the cover 19, by flowing a heated foodgrade hot melt adhesive between the foil seal 27 and the cover 19. The concave shape of the internal cover 19 insures that a thin layer of adhesive is placed between the cover and the foil seal. The cover 19 protects the apertures 14, and filters 16 from the adhesive, and also insures an open passage through the spike receiving opening 13. Suitable food contact adhesives which may be used are ethylene vinyl acetate based adhesive, (H. B. Fuller HL 7434); and polyethylene based adhesive, (H. B. Fuller HM 1002)

Figure 4:
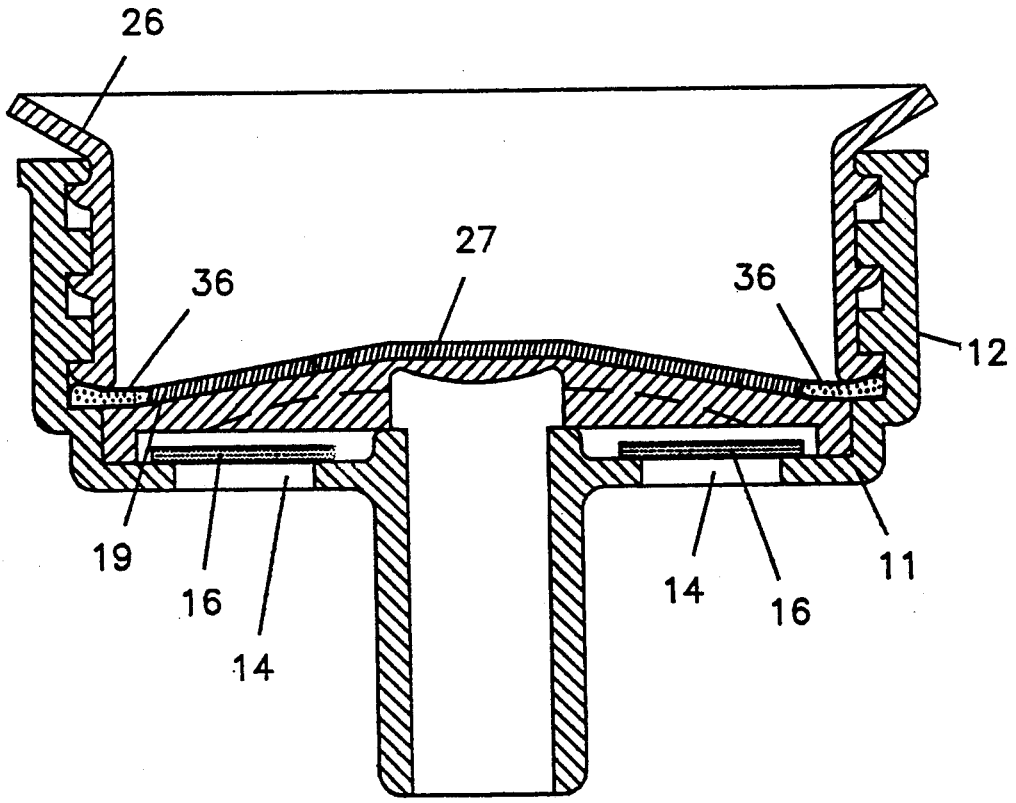
FIG. 4 is a perspective view showing a gasket assembly of the closure device of this invention.

In an additional embodiment of the invention, a gasket 36 may be used in place of the hot melt adhesive (see FIG. 4). The gasket 36 may be formed in situ, or may be preformed, and is aseptically installed in the closure device 10.

Figure 5:
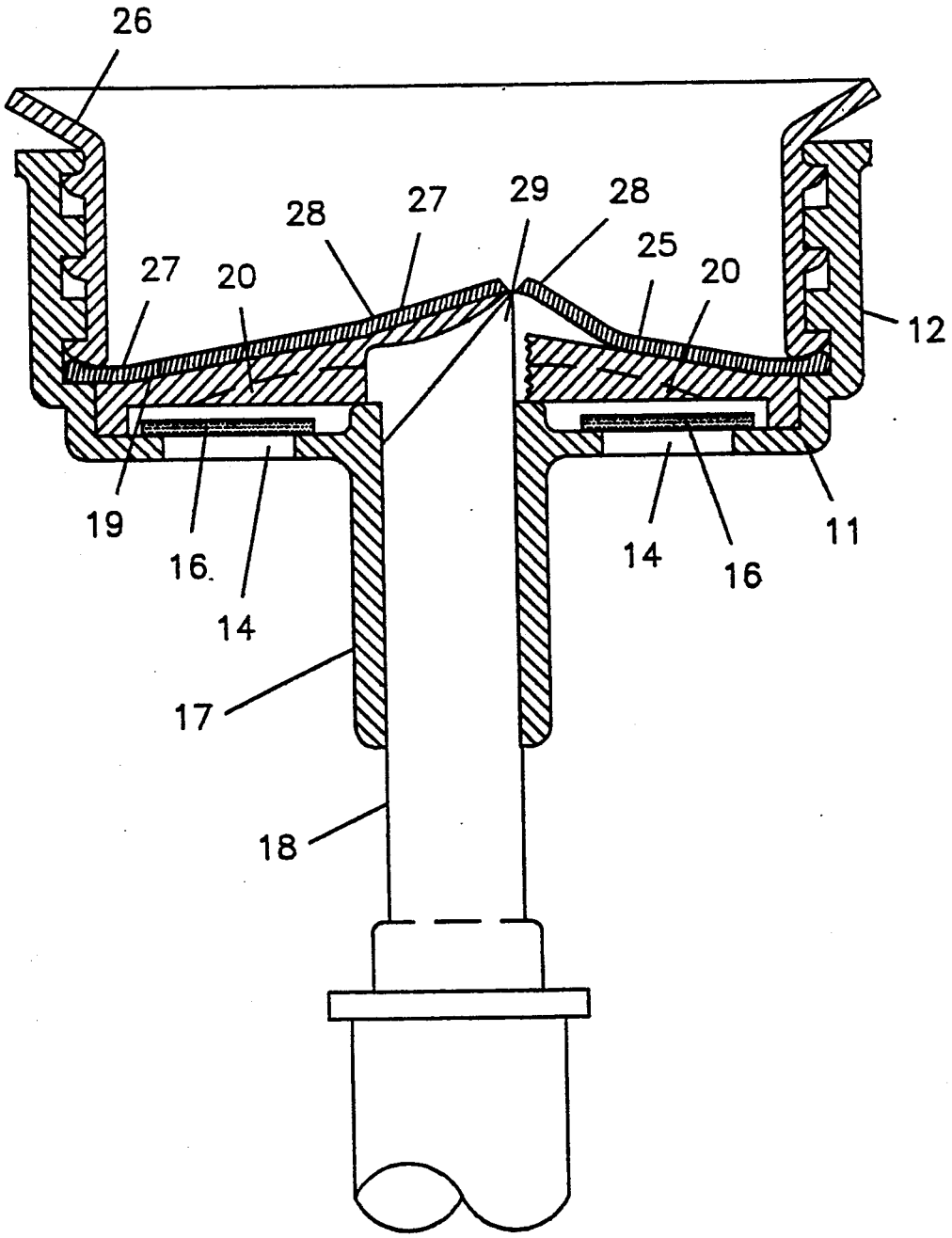
FIG. 5 is a perspective view showing the internal operation of a spike.

The center portion 22 of the cover 19 is surrounded by a weakened area 28. It is preferred that the diameter of the weakened area 28 be larger than the piercing spike 18. The weakened area 28 breaks when the spike 18 is urged against it. As the spike 18 moves against the weakened area 28, the part closest to the tip 29 of the spike 18 breaks first (see FIG. 5). The weakened area 28 continues to break as the spike moves in the spike receiving opening 13.

Figure 6:
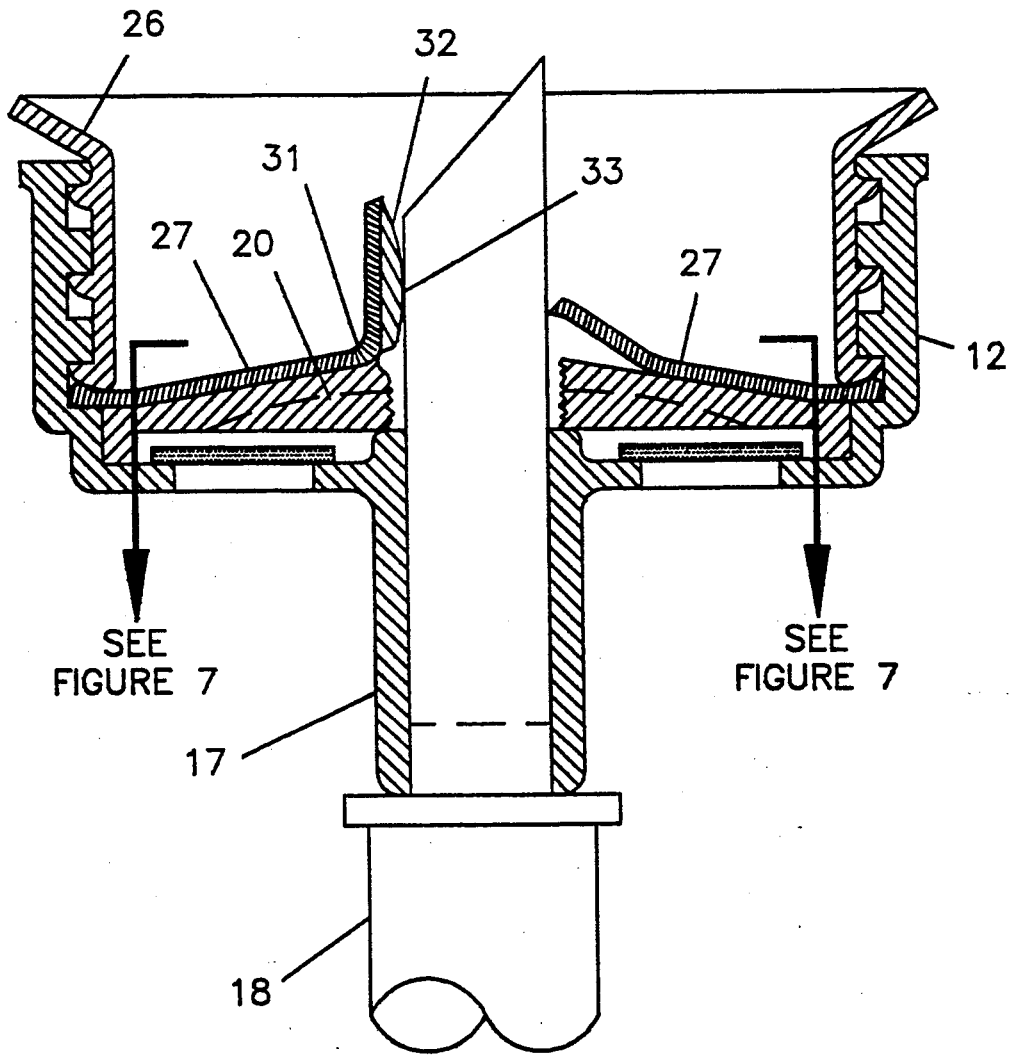
FIG. 6 is a perspective view showing the spike of FIG. 4 fully inserted in the device.
Figure 7:
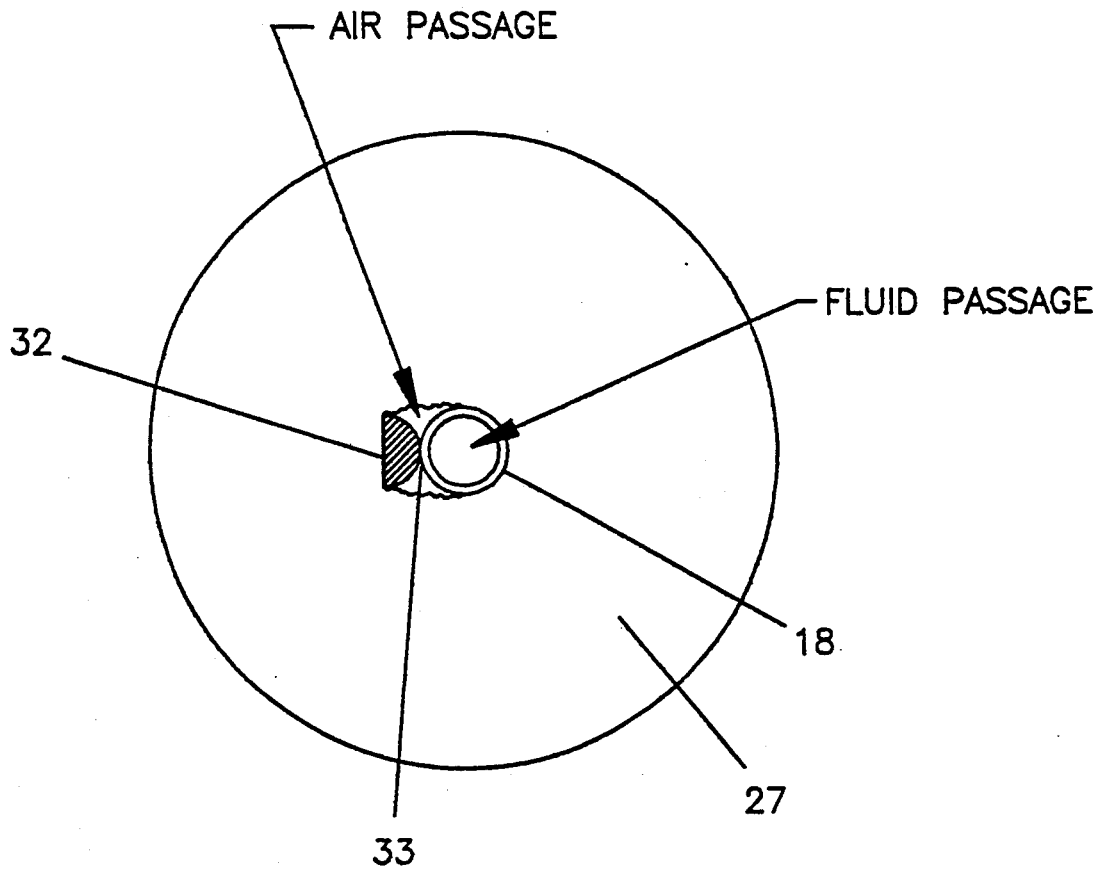
FIG. 7 is a Top View along the line 7—7 of FIG. 6 showing the rupture of seal 27.

As shown in FIG. 6, the weakened area 28 does not sever completely from the cover 19, but forms a hinge 31 on the side opposite the tip 29 of the spike 18. The hinge 31 and the center 22, thus form a flap 32 in the cover 19. As the flap 32 is raised by the spike 18, the seal 27 is ruptured, and the spike 18 enters the container 26. The flap 32 keeps the ruptured seal 27 away from the spike 18, insuring that air from the filter has access to the container 26. The spike 18 should penetrate sufficiently far into the container 26 so as not to draw air into the conventional central enteral fluid pathway of the spike. In a preferred embodiment of the flap 32, the innersurface of the center portion 22 e.g., the side facing the base section 11, is convex in shape 33. Thus, only the convex portion of the flap 32 rests on the spike 18, insuring that a sufficient air opening is maintained into the container, see FIG. 7. Though the cover 19 has been preferably described as having a center portion 22, with a circular weakened area 28, other spike penetrating weakened areas may be employed. For example, a weakened area in the form of a cross, triangle and the like, may be used. These alternate weakened areas sections are also pierceable by a spike, and provide air access to the container.

A cap 34 may be placed over the external end of the cylindrical member 17, to prevent contamination of the closure device 10 prior to use. The cap may be teathered to the cylindrical member (not shown).

Figure 8:
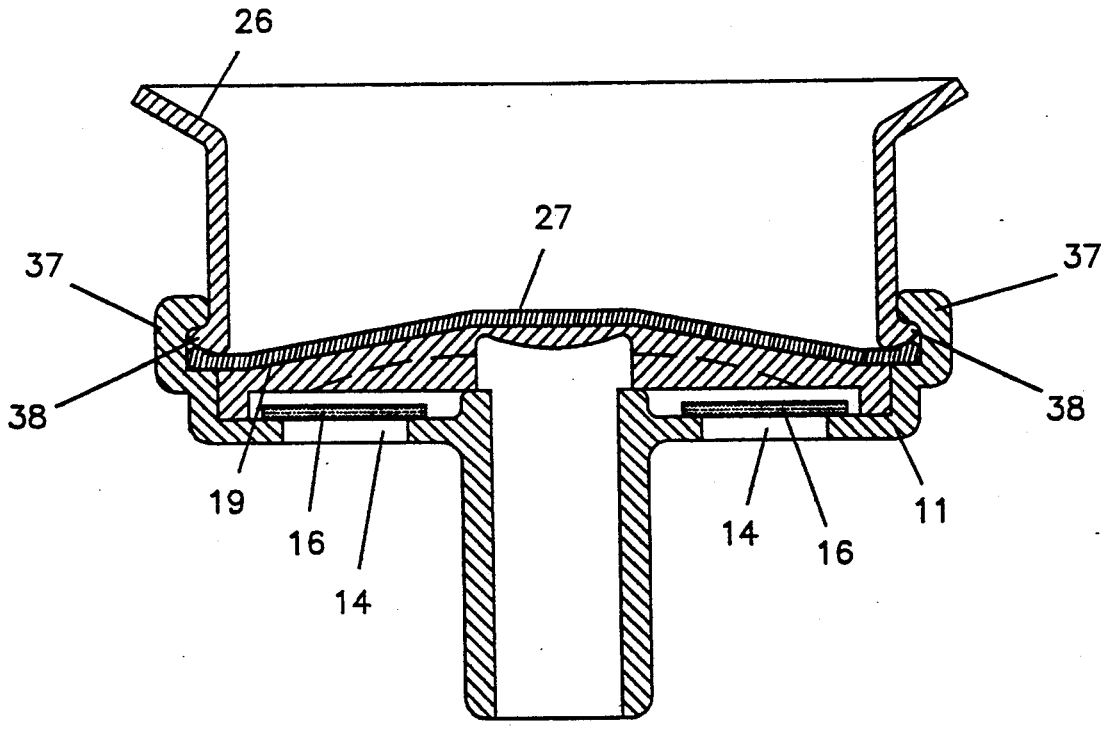
FIG. 8 is a perspective view showing a snap-fit assembly of the closure device on a container.

It is also within the scope of this invention, to use a snap-fit assembly of the closure device 10 and the container 26, thus, eliminating the threaded assembly. As shown in FIG. 8, a circumferential tab section 37 projecting from the base section 11, engages a rim 38 on the container 26, securing the closure device 10 to the container 26. After engagement, the closure device 10 may be further adhered to the container 26 by e.g., sonic welding.

Figure 9:
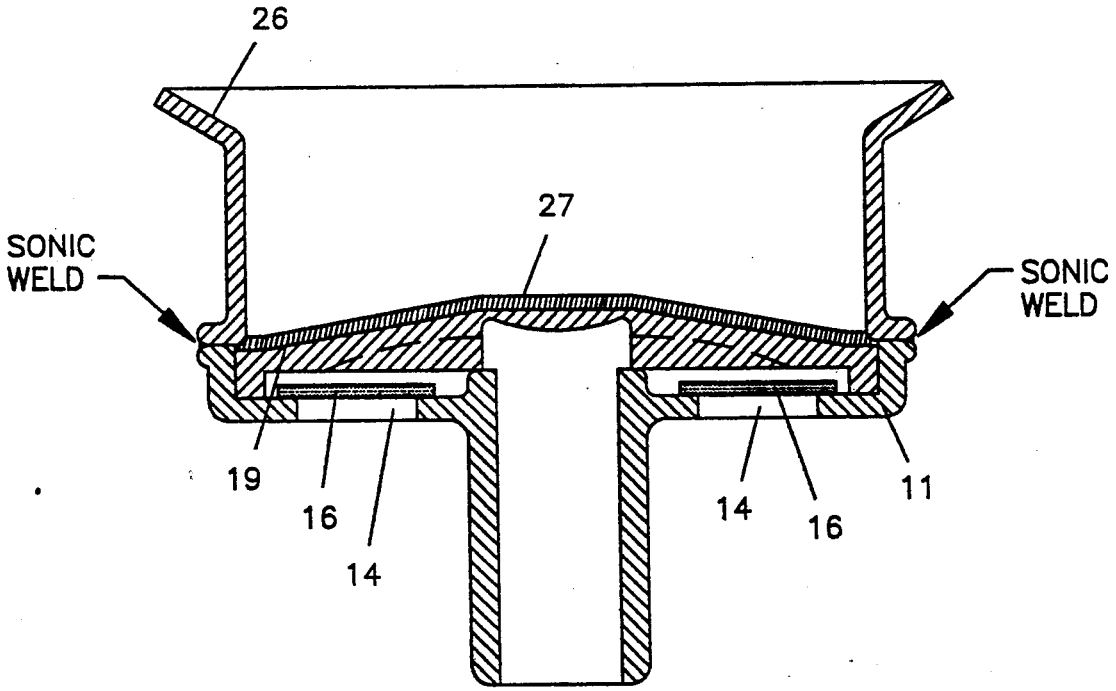
FIG. 9 is a perspective view showing the closure device sealed across a container opening.

The closure device 10 may also be sealed across a container opening without a threaded assembly, or snap-fit assembly by sealing e.g., sonic welding the base section 11 across the container opening, as shown in FIG. 9.

The closure device 10 of this invention when connected to an enteral fluid container, may be sterilized as a unit with the container. Alternately, the structure of the closure device 10 allows for it to be sterilized separate from an enteral fluid container. The internal cover 19 and cap 34, protects the internal portions of the device from contamination after sterilization.

To administer enteral fluid to a patient using the closure device of this invention, the cap 35 is removed, and a spike 18 (attached to an enteral delivery set) is plunged into the cylindrical member 17 and spike receiving opening 13 breaking the weakened area 28, and the container foil seal 27 as described above, thus releasing the enteral fluid to the patient, and allowing the fluid container to properly vent to the atmosphere.

What is claimed is:

1. A closure device for connection to a fluid container having a container opening for receiving the device comprising;

a base section sealably covering said container opening, said base section having a spike receiving opening passing there through, and at least one aperture spaced from said spike receiving opening;

an air filter component associated with said aperture;

an internal cover adjoining said base section, and covering said aperture; said covering having a pierceable portion which is a weakened area in alignment with said spike receiving opening of said base section, said pierceable portion comprising a hinge and flap when pierced by a spike.

2. A closure device for connection to a fluid container having a fluid opening, with a pierceable protective seal covering the fluid opening and a threaded connection for receiving the closure device comprising;

a base section and a threaded wall portion projecting from said base section, said wall portion adapted to threadly receive said threaded connection of said fluid container, said base section having a spike receiving opening passing there through, and at least one aperture spaced from said spike receiving opening;

an air filter component associated with said aperture;

an internal cover adjoining said base section of said closure device, and covering said aperture, said cover having a pierceable portion which is a weakened area in alignment with said spike receiving opening of said base section, said pierceable portion comprising a hinge and flap when pierced by a spike.

3. The closure device of claim 2 having a plurality of apertures in the base section.

4. The closure device of claim 2 wherein the air filter is composed of hydrophobic material.

5. The closure device of claim 2 having a cylindrical member aligned with spike receiving opening of the base section.

6. The closure device of claim 2 wherein the pierceable portion comprises a center portion surrounded by a weakened area, the weakened area adaptable to be pierced by a spike.

7. The closure device of claim 6 wherein the innersurface of the center portion is convex in shape.

8. The closure device of claim 5 wherein the external end of the cylindrical member is covered by a cap.

9. The closure device of claim 6 wherein the container seal and the inner cover are adhesively sealed together with a food grade adhesive.

10. The closure device of claim 6 wherein a gasket is in position between the container seal and the inner cover.

11. A closure device for connection to a fluid container having a fluid opening, with a pierceable protective seal covering the opening; and the opening having an external rim; said closure device comprising;

a base section with a circumferential tab section projecting from said base section, said section engaging said external rim, said base section having a spike receiving opening passing there through, and at least one aperture spaced from said spike receiving opening;

an air filter component associated with said aperture;

an internal cover adjoining said base section of the closure device and covering said aperture, said cover having a pierceable portion which is a weakened area in alignment with said spike receiving opening of said base section, said pierceable portion comprising a hinge and flap when pierced by a spike.

* * * * *